United States Patent [19]

Haines

[11] 4,180,263

[45] Dec. 25, 1979

[54] TENNIS RACQUETS

[75] Inventor: Robert C. Haines, Huddersfield, England

[73] Assignee: Dunlop Limited, London, England

[21] Appl. No.: 876,049

[22] Filed: Feb. 8, 1978

[30] Foreign Application Priority Data

Feb. 17, 1977 [GB] United Kingdom ..... 06597/77
Apr. 21, 1977 [GB] United Kingdom ..... 16556/77

[51] Int. Cl.[2] ..... A63B 49/00
[52] U.S. Cl. ..... 273/73 G
[58] Field of Search ..... 273/73 R, 73 C, 73 D, 273/73 G, 73 H

[56] References Cited

U.S. PATENT DOCUMENTS

| | | | |
|---|---|---|---|
| 3,582,073 | 6/1971 | Melnick et al. | 273/73 H |
| 3,840,230 | 10/1974 | Schaefer et al. | 273/73 C X |
| 3,908,995 | 9/1975 | Portz | 273/73 G |
| 3,958,805 | 5/1976 | Cooper | 273/73 G |
| 4,045,025 | 8/1977 | Staub et al. | 273/73 G X |

FOREIGN PATENT DOCUMENTS

| | | | |
|---|---|---|---|
| 798744 | 11/1968 | Canada | 273/73 H |

*Primary Examiner*—Richard J. Apley
*Attorney, Agent, or Firm*—Stevens, Davis, Miller & Mosher

[57] ABSTRACT

A throat piece for a tennis racquet has a series of indentations which provide parallel ridges and depressions on its two major faces. The ridges on one face constitute the depressions on the other face. The longitudinal racquet strings pass across the throatpiece in contact with the wall of the indentations and are diverted thereby into the racquet frame. Preferably alternate strings pass on opposite faces of the throatpiece but in the same plane. The structure is preferably of crenellated shape and may be of metal or plastics material.

17 Claims, 7 Drawing Figures

TENNIS RACQUETS

This invention relates to tennis racquets and particularly to a throat piece for a tennis racquet.

It has previously been proposed to use plastic throat pieces in tennis racquets. These can be made by injection moulding so that the strings can be guided by integrally moulded tunnels. However it has been found that such plastic throat pieces when made sufficiently light are not always sufficiently strong. Metal throat pieces on the other hand can be made very strong but have a weight problem in that metals generally are heavier than plastics material. The present invention overcomes this problem by providing a, for example, crenellated structure which enables these disadvantages of both metal and plastics throat pieces to be overcome. Sufficiently strong and sufficiently light structures can be made in either metal or plastics material using the structure of the present invention.

Thus, in one aspect the invention provides a throat piece for a tennis racquet, the throat piece being shaped to fit in the throat area of the racquet and having a series of indentations defining substantially parallel ridges and depressions on each of its two major faces, the indentations being aligned to receive longitudinal strings of the racquet and to divert them from the longitudinal direction into the racquet frame and wherein the ridges on one major face constitute the depressions on the other major face and vice versa.

A further aspect the invention provides a tennis racquet having a frame and incorporating a throat piece of the immediately preceding paragraph.

The invention also includes a strung tennis racquet of the type of the immediately preceding paragraph.

It will be appreciated, therefore, that the throat piece when in place in a tennis racquet frame completes the stringing area of the frame or "head" area of the racquet, which area may be for example of generally oval or circular shape.

In one embodiment of the invention, the throat piece is made of metal and low-density metals are preferred. In another embodiment, the throat piece is made of plastics material, e.g. nylon, polycarbonate, A.B.S., or acetal. The plastics material, if desired, may be reinforced with fibers, e.g. glass fibers.

In a particularly preferred embodiment the throat piece has indentations which give it a crenellated shape and the invention will be further described with particular reference to this embodiment.

Indentations of other shapes may be used, if desired, for example to give a corrugated shape.

In another preferred embodiment of the invention the throat piece is advantageously formed with one or more slots along the edge which is to complete the stringing area of the racquet. For example, that edge may be formed with a collar providing two flanges, each extending substantially normal to the plane of the throat piece, one flange being on each face of the throat piece. The collar can be formed with one or more slots embracing the plane of the strings and running generally transversely with respect to the racquet frame, i.e. across its width. The slots provide means of entry for the longitudinal racquet strings to the crenellations of the throat piece and these slots may be used as an alternative to holes. However holes may be used if desired. A single slot can accommodate more than one racquet string and, if desired, one slot could traverse substantially the whole length of the collar. In a preferred embodiment two slots are formed, each commencing near one edge of the collar and terminating a little short of the center point of the collar. This gives a solid region in the center of the collar which gives added strength to the construction. The collar may be designed to any required thickness or shape in order to give the required strength and stiffness subject of course to overall weight considerations.

The sides of the throat piece that contact the frame of the racquet when the throat piece is in position can also be provided with slots rather than holes to let the strings pass through.

The frame of the tennis racquet is preferably made from drawn or extruded metal sections and these can conveniently be hollow or alternatively incorporate continuous hollow cavities running the length of the frame so that the frame has high strength but low weight. It may be a one-piece section and in a preferred embodiment the metal frame is bent into a substantially key-hole shape in which the stringing area is defined by the, for example, part-oval or part-circular area of the key-hole and the handle area is defined by the extensions of the frame forming the elongated narrow portion of the key-hole. In this embodiment the throat piece of the invention fits into the frame in the area between the handle and the stringing area and thereby completes the stringing area.

The indentations of the throat piece against which the longitudinal strings are forced to lie under the action of the tension in the string allow the strings to be correctly positioned with respect to the frame and guide the strings from the longitudinal direction into suitable holes in the shoulder area of the frame. By this means the tension which is normally incorporated into the strings can be resisted mainly by the frame itself.

It will normally be desirable to hold the throat piece firmly in position in the shoulder area of the frame and this may be achieved for example by screws through the frame into the sides of the throat piece. It will therefore be appreciated that in such a case, where slots are used, the slots cannot extend for the entire length of the sides of the throat piece and a non-slotted length must be provided to accommodate each screw where required. Such lengths can conveniently be adjacent the ends of each side and the ends of the collar. In one embodiment it has been found convenient to provide two slots each extending from a central unslotted region of the collar towards one end of the collar but terminating short of that end. Each slot can accommodate several, for example four, strings. Between the outermost end of each slot and the end of the collar is provided an unslotted region, particularly for strength reasons. In this region individual holes may be incorporated to allow the outermost strings to pass into the throat piece.

The crenellations may be arranged so that the strings passing through the throat piece all lie substantially in one plane and this in the preferred arrangement. However, this is not essential in practice and the strings on either side of the throat piece may lie in planes which are not coincident although it is preferred that the strings do not impinge on the edges of the holes or slots in the collar.

As indicated above, low density metals are preferred for the throat piece of the invention and alloys of aluminium or magnesium have been found to be particularly useful. Preferred thicknesses of the metal making up the throat piece of course vary with the strength and density of the metal used but as a typical example an aluminium or magnesium alloy sheet could conveniently be from 1.25 to 1.75 millimeters thick.

The metal sheet may be formed into the desired crenellated configuration by, for example, machining from a metal plate but it is preferred to use a casting process, e.g. die-casting or investment-casting.

As indicated above, the metal throat piece may if desired be coated with for example a plastics coating of a nylon or an epoxy resin.

A throat piece of the invention can be made to weigh under 35 grammes and a satisfactory nylon-coated magnesium throat piece has been made weighing only 32 grammes.

Where the throat piece is of plastics material, a thicker sheet may be required but sufficient strength at acceptable weights is achievable by virtue of the, e.g. crenellated, structure used.

In another preferred embodiment of the invention the position and shape of the crenellations is such that alternate strings of the racquet appear on opposite faces of the throat piece.

The invention is further illustrated with reference to the accompanying drawings in which.

Figure 1:
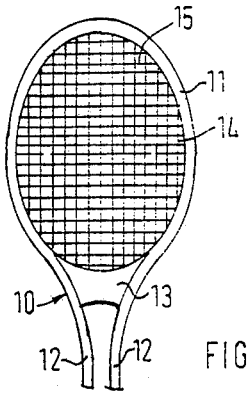
FIG. 1 is a diagrammatic representation of a tennis racquet having a key-hole-shaped frame and a throat piece.

In FIG. 1 racquet 10 has a key-hole frame formed by substantially oval frame section 11 and handle sections 12. Throat piece 13 in the throat area of the racquet completes the overall stringing area.

Figure 2:
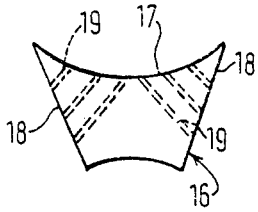
FIG.2 PRIOR ART
FIG. 2 is a representation of a prior art throat piece.

FIG. 2 shows a moulded plastics throat piece of 16 of the prior art. This has a curved edge 17 to complete the stringing area of a racquet and substantially straight edges 18 to mate with the racquet frame in the throat area. Throat piece 17 has moulded-in holes 19 passing through its body and these holes are to receive the longitudinal strings of a racquet and to guide them through the throat piece to the side of the racquet frame in the throat area.

Figure 3:
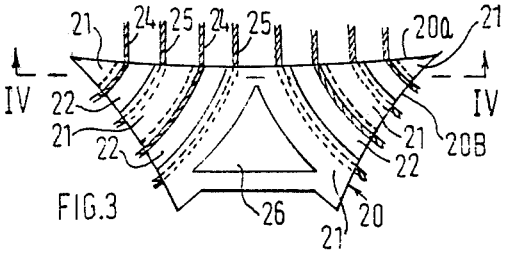
FIG. 3 is a plan view of a throat piece of the invention and showing the longitudinal strings of the racquet passing through it.

In FIG. 3 a throat piece 20 of the present invention is in the form of a cast crenellated metal sheet. Its edge 20A is to complete the stringing area of a racquet frame and its edges 20B are to mate with the frame in the throat area. The throat piece is in the form of a series of crenellations defined by flat ridges 21 and flat depressions 22, each pair of adjacent ridges and depressions being joined by an upstanding wall 23. (It will be readily appreciated that, viewed from the other face, ridges 21 will actually be depressions and depressions 22 will actually be ridges). The ridges and depressions run parallel to each other and curve from edge 20A into one or other of the two edges 20B. Longitudinal racquet strings 24 and 25 are passed across one or other face of the throat piece each in contact with an upstanding wall 23 and in a manner such that the tension in the string forces the string into close contact with the wall. The strings are thereby diverted from the longitudinal direction into the frame at the edge of the throat piece. In the embodiment shown, eight longitudinal strings are passed across the throat piece. The central pair of strings 25 pass on one side of the throat piece as shown and the strings alternate on opposite sides of the throat piece going from the center to each edge, strings 24 being shown together on one side. As a means of reducing weight the throat piece has been formed with a central triangular hole 26.

Figure 5:
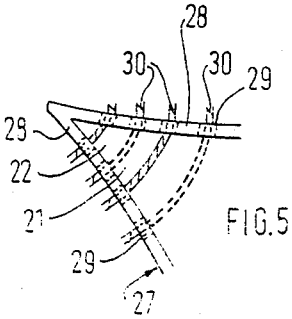
FIG. 5 is a plan view of a fragment of an alternative throat piece of the invention.

In the embodiment shown in FIG. 5, metal throat piece 27 has a reinforcing border 28 around its edges for added strength. The border is provided with oversized holes 29 so that strings 30 can pass through the throat piece without coming into contact with the edges of the holes. The throat piece otherwise has the basic crenellated shape of that of FIG. 3 with similar ridges 21 and depressions 22.

Figure 4:
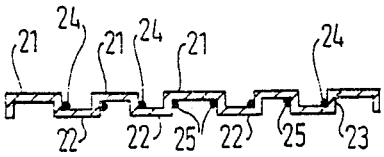
FIG. 4 is a section along line IV—IV of FIG. 3.
Figure 6:
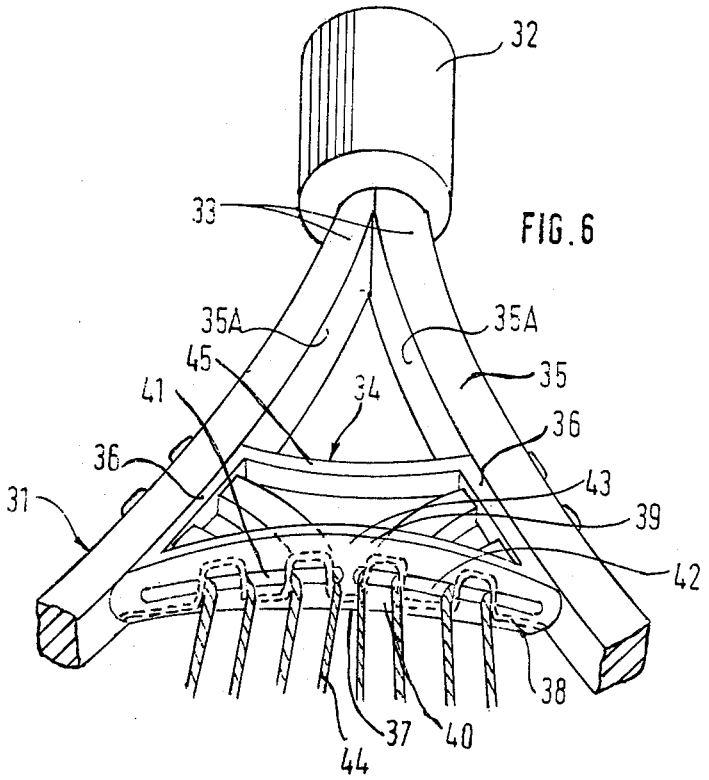
FIG. 6 is a fragmentary perspective view of a racquet of the invention containing a further alternative form of throat piece and viewed from the head end of the racquet.
Figure 7:
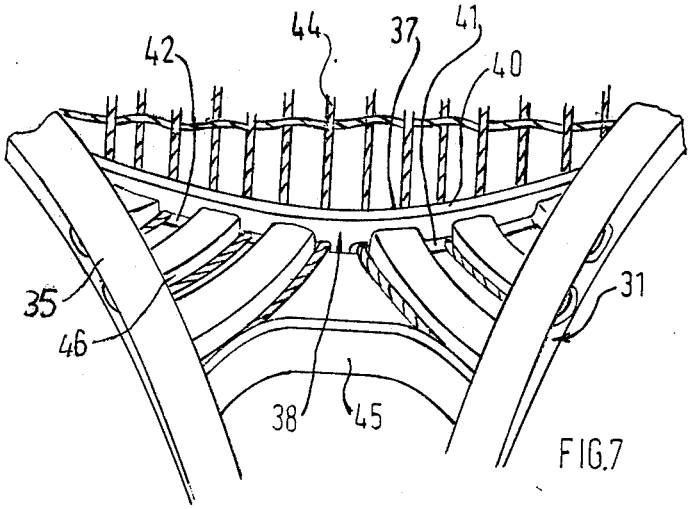
FIG. 7 is a fragmentary perspective view of the racquet of FIG. 6 from the handle end of the racquet.

The embodiment shown in FIGS. 6 and 7 is similar to that of FIGS. 3 and 4 in which a tennis racquet 31 has a handle 32 encasing the parallel handle end of sections 33 of frame 35. The inner periphery 35A of frame 35 is contoured to mate with the outer periphery of edges 36 of a metal throat piece 34. As in the embodiment of FIG. 3, the throat piece 34 has parallel series of indentations having ridges and depressions of substantially flat form which extend from one or other edge 36 of the throat piece to the edge 37 which completes the stringing area of the racquet. Edge 37 of throat piece 34 is formed with a collar 38 designed to increase the bending strength of the throat piece which effectively provides a pair of flanges 39 and 40, each extending substantially normal to the plane of the throat piece, one flange being on each face of the throat piece. The collar has a pair of slots 41 and 42 which run substantially transversely with respect to the racquet frame. Each slot commences at a central area 43 of the collar and runs almost to the edge at one side. The slots provide entry for the longitudinal strings 44 of the racquet into the throat piece where they are forced under the tension of the string to lie against the upstanding walls 46 and so are guided into the side of the racquet frame 35. The edge 45 of the throat piece which is remote from the stringing area of the racquet is also formed in the form of an upstanding collar 45 to provide added strength.

Having thus described my invention, what I claim is:

1. A throat piece for a tennis racquet having a frame defining an open throat, the throat piece having two generally parallel major faces bounded by a top edge, a bottom edge and two side edges, the side edges being shaped complementary to said frame to fit in the throat area of said racquet so that the top edge of the throat piece completes the stringing area of the racquet, said throat piece having a series of indentations across its width, said indentations defining substantially parallel ridges and depressions on each of the two major faces of the throat piece, said indentations having ends facing toward said top edge and following generally curved paths extending downwardly and aligned to receive longitudinal strings of the racquet and to divert them from the longitudinal direction into the racquet frame, and wherein said ridges on one of said major faces constitute said depressions on the other major face and vice versa.

2. A throat piece according to claim 1, which is made of metal.

3. A throat piece according to claim 2, in which said metal is selected from the class consisting of alloys of aluminium and alloys of magnesium.

4. A throat piece according to claim 2, which is a one-piece casting with a coating of plastics material.

5. A throat piece according to claim 1, which is made of plastics material.

6. A throat piece according to claim 5, in which the plastics material is selected from the class consisting of nylon, polycarbonate, A.B.S. and acetal and fibre-reinforced products thereof.

7. A throat piece according to claim 1, in which slots are provided along said top edge of the throat piece, above the ends of the indentations, to receive said longitudinal racquet strings, said slots being of sufficient size to admit said strings.

8. A throat piece according to claim 7, in which a collar is formed on said top edge and the slots are formed in said collar.

9. A throat piece according to claim 8 in which said collar contains two said slots, each commencing adjacent one extremity of the collar and terminating adjacent its center point.

10. A throat piece according to claim 7, in which the side edges of the throat piece which contact the frame of said racquet are also provided with slots for the strings to pass through.

11. A throat piece according to claim 1, in which the top edge of the throat piece is provided with a border, said border containing holes through which said strings can pass.

12. A throat piece according to claim 1, in which said indentations provide a crenellated shape.

13. A tennis racquet comprising a frame having a head portion and a handle portion, said head portion partially defining an area for stringing, and a throat piece having two generally parallel major faces bounded by a top edge, a bottom edge and two side edges, said top edge completing said stringing area, the side edges of said throat piece being shaped complementary to said frame to fit in the throat area of said racquet, said throat piece having a series of indentations across its width said indentations defining substantially parallel ridges and depressions on each of the two major faces, said indentations having ends facing toward said top edge and following generally curved paths extending downwardly and aligned to receive longitudinal strings of the racquet and to divert them from the longitudinal direction into said frame, wherein said ridges on one of said major faces constitute said depressions on the other major face and vice versa.

14. A tennis racket according to claim 13, in which said throat piece is made of metal selected from the class consisting of alloys of aluminium and alloys of magnesium and is coated with plastics material.

15. A tennis racket according to claim 13 complete with stringing and in which alternate longitudinal strings pass on opposite faces of the throat piece.

16. A tennis racquet having a frame made of drawn or extruded metal in one piece which is bent into substantially key-hole shape to provide a handle portion and a head portion which partially defines a stringing area for said racquet, a throat piece in the open part of said head portion having two generally parallel major faces bounded by a top edge, a bottom edge and two side edges, said top edge completing said stringing area, the side edges of said throat piece being of complementary shape to said frame in the throat area of the racquet and having a series of indentations having ends facing toward said top edge and extending downwardly, said indentations defining substantially parallel ridges and depressions on each of the two major faces of the throat piece, said indentations being aligned to receive longitudinal strings of the racquet and to divert them from the longitudinal direction into said frame, wherein said ridges on one of said major faces constitute said depressions on the other major face and vice versa.

17. A throat piece according to claim 13, in which said indentations provide a crenellated shape.

* * * * *